US008172167B2

(12) United States Patent
Hedin et al.

(10) Patent No.: US 8,172,167 B2
(45) Date of Patent: May 8, 2012

(54) CRUSHING PLANT AND METHOD FOR CONTROLLING THE SAME

(75) Inventors: Olle Hedin, Alfta (SE); Anders Nilsson, Limhamn (SE); Jonny Wallin, Malmö (SE); Richard Bern, Svedala (SE); Göran Forsberg, Bollnäs (SE)

(73) Assignee: Sandvik Intellectual Property AB, Sandviken (SE)

( * ) Notice: Subject to any disclaimer, the term of this patent is extended or adjusted under 35 U.S.C. 154(b) by 131 days.

(21) Appl. No.: 12/663,969

(22) PCT Filed: Jun. 15, 2007

(86) PCT No.: PCT/SE2007/000588

§ 371 (c)(1),
(2), (4) Date: Mar. 8, 2010

(87) PCT Pub. No.: WO2008/153454

PCT Pub. Date: Dec. 18, 2008

(65) Prior Publication Data

US 2010/0181396 A1 Jul. 22, 2010

(51) Int. Cl.
*B02C 4/32* (2006.01)

(52) U.S. Cl. ..... 241/37; 241/207; 241/214; 241/217

(58) Field of Classification Search ..... 241/30, 241/37, 207–216

See application file for complete search history.

(56) References Cited

U.S. PATENT DOCUMENTS

| | | | | |
|---|---|---|---|---|
| 1,894,601 | A | 1/1933 | Symons | |
| 5,509,610 | A * | 4/1996 | Gibbons et al. | 241/37 |
| 6,719,226 | B2 * | 4/2004 | Rajewski | 241/30 |
| 2002/0017577 | A1 * | 2/2002 | Rajewski | 241/30 |
| 2007/0145168 | A1 * | 6/2007 | Theberge et al. | 241/30 |
| 2009/0095827 | A1 * | 4/2009 | Posti et al. | 241/30 |

FOREIGN PATENT DOCUMENTS

| | | |
|---|---|---|
| EP | 0 306 594 | 3/1989 |
| GB | 2 211 004 | 6/1989 |
| WO | 02/36264 | 5/2002 |
| WO | 2006/067277 | 6/2006 |
| WO | 2007/051890 | 5/2007 |

* cited by examiner

*Primary Examiner* — Bena Miller

(74) *Attorney, Agent, or Firm* — Morgan, Lewis & Bockius LLP

(57) ABSTRACT

There is described a crushing plant and a method for controlling the same. The crushing plant involves a gyratory crusher (1) with means for controlling a minimum gap in a crushing chamber, and is driven by a diesel engine (18). A load value is retrieved from the diesel engine e.g. by means of a J1939 interface. If the retrieved value exceeds a predetermined threshold value, the minimum gap is increased. Thereby it can be avoided that the diesel engine stalls; such that continuous operation of the crushing plant may be ensured.

5 Claims, 2 Drawing Sheets

CRUSHING PLANT AND METHOD FOR CONTROLLING THE SAME

RELATED APPLICATION DATA

This application is a §371 National Stage Application of PCT International Application No. PCT/SE2007/000588 filed Jun. 15, 2007.

TECHNICAL FIELD

The present disclosure relates to a crushing plant comprising a gyratory crusher, having a vertical shaft, a crushing head mounted on the shaft, an inner shell being attached to the crushing head, and an outer shell, arranged to surround the inner shell such that a crushing chamber is formed between the inner and outer shells, the chamber having a minimum gap, which is decisive for the crushing function of the crushing plant, the crushing plant further comprising a drive unit which drives the crusher, and control means for controlling the minimum gap by axial displacement of the inner and outer shells in relation to each other. The disclosure further relates to a method for controlling a crushing plant of the above indicated kind.

BACKGROUND

Crushing plants of the above mentioned kind are well known and are used e.g. to refine blast rock into gravel. It is desirable to provide a crushing plant that is moveable, such that it can be operated at different locations, e.g. at a road construction site. However, in mobile operation, raw material is often fed to the crushing plant using an excavator or the like, which means that a lot of raw material may be instantaneously fed to the crushing plant. The result may be that the crusher stops, which causes an interruption in the production and necessitates manual clearing up of the crusher to enable restart of the crushing plant.

SUMMARY OF THE INVENTION

An object of the present invention is to provide a crushing plant which, at least partly, obviates the above mentioned problem.

This object is achieved with a crushing plant as defined in claim 1 or by a method for controlling a crushing plant as defined in claim 5.

More specifically, a crushing plant of the initially mentioned kind then has a drive unit being a diesel engine, comprises means for retrieving a parameter value from the diesel engine which is correlated to the load thereof, means for comparing the retrieved value with a threshold value, and means for increasing the minimum gap of the crusher chamber if the retrieved value exceeds the threshold value.

In a crushing plant of this kind, the risk for unintentional stopping of the crusher will be substantially reduced.

The crushing plant may further comprise means for generating a warning if the retrieved value exceeds the threshold value. This informs the personnel running the crushing plant that an overload condition has occurred such that they can reduce the feeding of raw material to the crusher.

The load parameter value may be retrieved via a J1939 interface, and the diesel engine may be controlled to a desired rotational speed (rpm) using a separate control loop.

A corresponding method comprises retrieving a parameter value from the drive unit which is correlated to the load thereof, wherein the drive unit is a diesel engine, comparing the retrieved value with a threshold value, and increasing the minimum gap if the retrieved value exceeds the threshold value. The method may further comprise generating a warning if the retrieved value exceeds the threshold value.

Further objects and features of the present invention will be apparent from the description and the claims.

DETAILED DESCRIPTION

Figure 1:
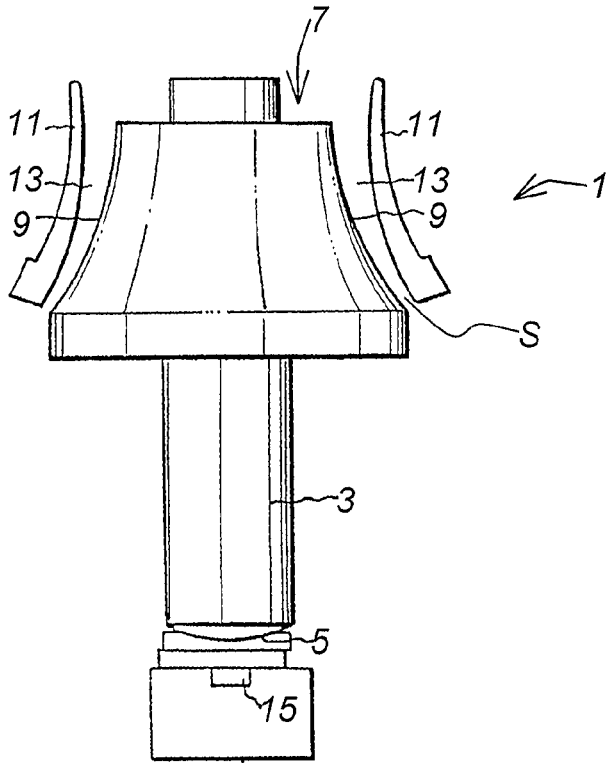
FIG. 1 illustrates schematically a gyratory crusher.

FIG. 1 illustrates schematically a gyratory crusher 1. The crusher 1 comprises a substantially vertical crusher shaft 3, which is eccentrically mounted at its lower end 5. In operation, the crusher shaft 3 will perform a simultaneous rotary and oscillating motion. The crusher shaft 3 carries, at its upper end, a crushing head 7, the outer surface of which is provided with an inner shell 9 consisting of a hard material.

An outer shell 11, shown in cross-section, is mounted in a machine frame (not shown) in such a way that it surrounds the inner shell 9, forming a ring-shaped crushing chamber 13 between the inner and outer shells 9, 11. As illustrated, the cross-sectional area of the crushing chamber 13 may decrease towards the lower part thereof. A minimum gap S between the inner and outer shells 9, 11 is provided at the bottom of the crushing chamber 13, and will, thanks to the simultaneous rotary and oscillating motion of the crusher shaft 3, continuously move around the periphery of the inner shell's 9 bottom part.

During operation raw material, typically blast rock material, is fed into the crushing chamber 13 at the top thereof, and is crushed between the inner and outer shells 9, 11 due to the relative motion between these parts. The size of the minimum gap S of the crushing chamber 13 is decisive for the crushing function that is carried out, for example for the size distribution and shape of the crushed material produced. In order to make the minimum gap S adjustable, it is possible to move the crusher shaft 3 in the vertical direction by means of an adjusting device 15, typically an hydraulic cylinder.

Figure 2:
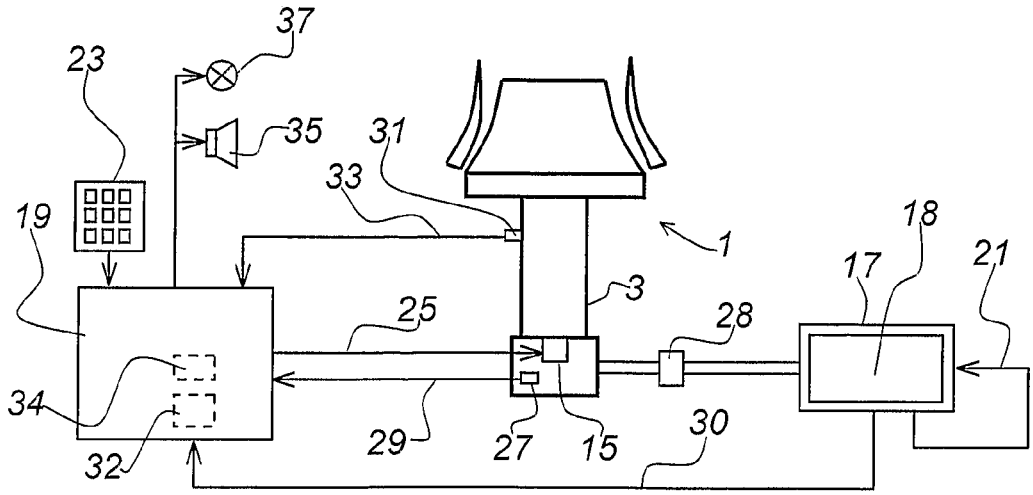
FIG. 2 illustrates a crushing plant.

FIG. 2 illustrates schematically a crusher 1 with a drive unit 17 and a control unit 19. The drive unit 17 comprises a diesel engine 18 which drives the crusher shaft 3 via a coupling unit (not shown). The use of a diesel engine 18 makes the crusher 1 suitable for a mobile configuration, as a connection to an electric power grid is not needed. The crushing plant may thus be moved from location to location and may therefore be used e.g. in connection with road construction, in order to refine blast rock to gravel. The diesel engine may be controlled, by means of a separate control loop 21, to run at a predetermined desired rotational speed, e.g. 1800 rpm.

The control unit 19 controls the adjusting device 15 of the crusher 1, i.e. makes the crusher shaft 3 move upwards or downwards, depending on different control parameters. The control unit 19 is responsive to inputs from input means 23, such as a keypad, such that a user may e.g. calibrate the crusher and set different operating parameters. If the adjusting device 15 is a hydraulic cylinder, the control unit 19 may control the hydraulic pressure thereof via a control line 25. There may also be arranged a pressure sensor 27 in the hydraulic cylinder which sensor produces a pressure signal to be fed to the control unit via a feedback line 29. Additionally, the crusher plant may have a position sensor 31 which measures the position of the shaft 3 and thus indirectly the minimum gap S of the crushing chamber, and feeds a corresponding sensor signal to the control unit 19 via a sensor line 33. The control unit 19 may thus control the hydraulic pressure and/or the gap S to desired values as is well known per se. The shaft between the drive unit 17 and the crusher 1 may be provided with an hydraulic coupling 28 that provides a soft-starting functionality to the crushing plant. The outgoing shaft of the hydraulic coupling may be provided with e.g. an inductive sensor to measure the rotational speed.

A diesel engine 18 of the drive unit 17 may stall if the applied load material which is fed into the crushing chamber 13 of the crusher 1 is too hard or dense, or if to much material is fed to the crusher 1. If this occurs, the crusher will have to be cleared from raw material before the diesel engine 18 can be restarted, which is a cumbersome and time consuming task.

Therefore, a load parameter value is retrieved from the diesel engine using a sensing line 30. The value is correlated to the load of the engine and may be retrieved using the well known J1939 interface. The load parameter value may be derived from the turbo-charging pressure and correspond to a percentage of the maximum load, i.e. 0-100%.

The control unit 19 comprises a comparator 32 which compares the retrieved load parameter value with a predetermined overload threshold value, e.g. 80%, and if the latter is exceeded, the minimum gap S of the crushing chamber 13 is increased by a limiter 34 in the control means 19, typically by lowering the hydraulic pressure of the adjusting device/hydraulic cylinder 15. Increasing the minimum gap S decreases the crushing work performed by the crusher, and hence results in a quick decrease in the load on the diesel engine 18. Thereby, overload and stalling of the diesel engine may be avoided.

Needless to say, most functional blocks of the control unit 19 may be software implemented. It may however be conceivable to implement parts of the control unit 19 as special hardware, e.g. using ASICs.

There may thus be provided a primary, inner control loop that measures the minimum gap S and/or the hydraulic pressure of the hydraulic cylinder, and controls either of these parameters to a desired value. Further, there is provided a secondary, outer loop that measures the diesel engine load and affects the inner loop if a load threshold value is exceeded by increasing the minimum gap S. Typically, the outer loop may decrease the minimum gap value set point of the inner loop.

Additionally, the control unit 19 may provide a warning by acoustic and/or optic means, typically a summer 35 and/or a lamp 37, if the threshold is exceeded. Alternatively, the warning may be provided before the overload threshold is exceeded by comparing the retrieved load parameter with a lower warning threshold and executing a warning if the latter is exceeded.

Figure 3:
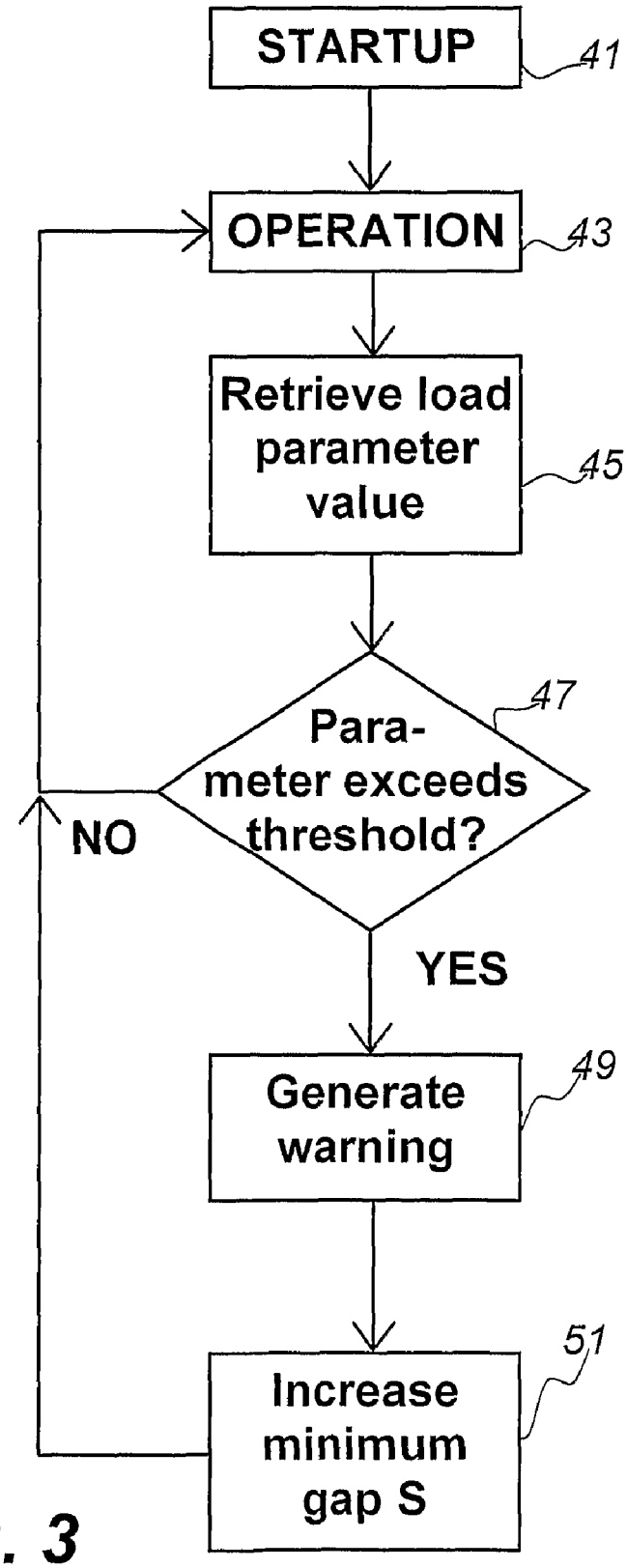
FIG. 3 shows the flow-chart of a method.

FIG. 3 shows the flow-chart of a method. From an initial start-up state 41, the crushing plant enters an operating state 43 where raw material is refined into gravel by crushing the raw material in a crusher. While in the operating state, a load parameter value is retrieved 45 from the diesel engine, and is compared 47 with a threshold. If the threshold is exceeded, indicating an overload condition, a warning is optionally generated 49, e.g. as mentioned by flashing a light, and the minimum gap S is increased 51 such that stalling of the diesel engine can be avoided. The crushing plant then continues in the operating mode and repeats the measuring procedure within a predetermined time. The minimum gap may thus be decreased further. If the comparing 47 results in the load parameter value being lower than the threshold, the operation of the crushing plant is simply continued. If the minimum gap has been increased and no new overload condition occurs within a predetermined time, the minimum gap may be decreased back to the normal value, optionally in a step-wise manner.

In summary, there is described a crushing plant and a method for controlling the same. The crushing plant involves a gyratory crusher with means for controlling a minimum gap in a crushing chamber, and is driven by a diesel engine. A load value is retrieved from the diesel engine e.g. by means of a J1939 interface. If the retrieved value exceeds a predetermined threshold value, the minimum gap is increased. Thereby it can be avoided that the diesel engine stalls, such that continuous operation of the crushing plant may be ensured.

The invention is not restricted to the described embodiments and may be varied within the scope of the appended claims. For instance, other adjustment devices than hydraulic cylinders are conceivable. The crusher 1 which has been described hereinbefore has a crushing head which is fixed to a crushing shaft. In accordance with an alternative embodiment, the crushing head could be slidable, by means of a hydraulic cylinder, along a fixed shaft, such as described in WO 2006/067277.

It will further be appreciated that the invention also may be applied on other types of crushers than the gyratory crushers described above, that has a hydraulic regulation of the vertical position of the inner shell. The invention may also be applied to, among other things, crushers that have a mechanical setting of the gap between the inner and outer shell, for instance the type of crushers described in U.S. Pat. No. 1,894,601 in the name of Symons. In the last-mentioned type of crushers, occasionally called Symons type, the setting of the gap between the inner and outer shell is carried out by the fact that a case, in which the outer shell is fastened, is threaded in a machine frame and turned in relation to the same for the achievement of the desired gap. In a variant of this type of crushers, instead of a thread, a number of hydraulic cylinders are utilized for the adjustment of the case in which the outer shell is fastened. The invention is applicable also to this type of crushers.

The invention claimed is:

1. A crushing plant comprising a gyratory crusher, having a vertical shaft, a crushing head mounted on the shaft, an inner shell being attached to the crushing head, and an outer shell, arranged to surround the inner shell such that a crushing chamber is formed between the inner and outer shells, the chamber having a minimum gap, which is decisive for the crushing function of the crushing plant;

a drive unit which drives the crusher, and control means for controlling the minimum gap by axial displacement of the inner and outer shells in relation to each other, wherein the drive unit comprises a diesel engine, and wherein the crushing plant comprises means for retrieving via a J1939 interface a parameter value from the diesel engine which is correlated to the load thereof, means for comparing the retrieved value with a threshold value, and means for increasing the minimum gap if the retrieved value exceeds the threshold value.

2. A crushing plant according to claim 1, wherein the crushing plant further comprises means for generating a warning if the retrieved value exceeds the threshold value.

3. A crushing plant according to claim 1, wherein the diesel engine is controlled to a desired speed using a separate control loop.

4. A method for controlling a crushing plant comprising a gyratory crusher, having a vertical shaft, a crushing head mounted on the shaft, an inner shell being attached to the crushing head, and an outer shell, arranged to surround the inner shell such that a crushing chamber is formed between the inner and outer shells, the chamber having a minimum gap, which is decisive for the crushing function of the crushing plant; a drive unit which drives the crusher, and control means for controlling the minimum gap by axial displacement of the inner and outer shells in relation to each other, the method comprising:

retrieving a parameter value via a J1939 interface from the drive unit which is correlated to the load thereof, wherein the drive unit is a diesel engine, comparing the retrieved value with a threshold value, and increasing the minimum gap if the retrieved value exceeds the threshold value.

5. A method according to claim 4, further comprising generating a warning if the retrieved value exceeds the threshold value.

* * * * *